US009273490B1

(12) United States Patent
McNeil

(10) Patent No.: US 9,273,490 B1
(45) Date of Patent: Mar. 1, 2016

(54) MULTIPLE PADLOCK LOCKING DEVICE

(71) Applicant: Randy McNeil, Estes Park, CO (US)

(72) Inventor: Randy McNeil, Estes Park, CO (US)

( * ) Notice: Subject to any disclaimer, the term of this patent is extended or adjusted under 35 U.S.C. 154(b) by 20 days.

(21) Appl. No.: 14/484,534

(22) Filed: Sep. 12, 2014

(51) Int. Cl.

| | |
|---|---|
| ***E05B 17/00*** | (2006.01) |
| ***E05B 67/38*** | (2006.01) |
| ***G05G 5/00*** | (2006.01) |
| ***E05B 63/14*** | (2006.01) |

(52) U.S. Cl.
CPC ..... *E05B 17/00* (2013.01); *E05B 63/143* (2013.01); *E05B 67/383* (2013.01); *G05G 5/005* (2013.01); *Y10T 70/40* (2015.04)

(58) Field of Classification Search
CPC ..... E05B 65/00; E05B 67/003; E05B 63/143; E05B 67/388; G05G 5/005; Y10T 70/483; Y10T 70/40; Y10T 70/409; Y10T 70/5611; F16P 3/08
USPC ..... 70/14, 18, 19, 51, 53, 58, DIG. 63, 200; 292/148
See application file for complete search history.

(56) References Cited

U.S. PATENT DOCUMENTS

| | | | | | |
|---|---|---|---|---|---|
| 539,650 | A * | 5/1895 | Searle | E05B 75/00 | 70/15 |
| 558,814 | A * | 4/1896 | Hunt | E05B 67/003 | 70/49 |
| 1,197,020 | A * | 9/1916 | Farrar | B60R 25/005 | 70/203 |
| 1,475,256 | A * | 11/1923 | Belair | E05B 67/003 | 24/134 R |
| 2,963,895 | A * | 12/1960 | Thomas | E05B 67/383 | 292/288 |
| 3,017,678 | A * | 1/1962 | Christensen | B63B 21/08 | 24/134 R |
| 3,889,497 | A * | 6/1975 | Tuttle | E05B 35/08 | 70/14 |
| 4,347,720 | A * | 9/1982 | Kenyon | E05B 67/003 | 70/14 |
| 4,864,834 | A * | 9/1989 | Waite | E05B 67/383 | 70/14 |
| 5,517,835 | A * | 5/1996 | Smith | E05B 73/0005 | 70/14 |
| 5,868,015 | A * | 2/1999 | Eaker | E05B 67/383 | 292/148 |
| 5,881,582 | A * | 3/1999 | Monaco | E05B 67/383 | 70/14 |
| 6,092,402 | A * | 7/2000 | Porcelli | A63C 11/005 | 70/18 |
| 6,857,299 | B2 * | 2/2005 | McNeil | E05B 67/383 | 292/148 |
| 7,100,937 | B2 * | 9/2006 | Hogan | B60D 1/065 | 280/14 |
| 7,293,438 | B2 * | 11/2007 | Benda | F16G 11/04 | 24/132 WL |
| 7,503,194 | B2 | 3/2009 | McNeil | | |
| 7,757,523 | B1 * | 7/2010 | Garcia | E05B 65/0007 | 292/148 |
| 8,297,086 | B2 * | 10/2012 | Yu | B62H 5/003 | 70/14 |
| 8,353,182 | B2 * | 1/2013 | Triffle | E05B 67/383 | 70/14 |
| 9,032,764 | B2 * | 5/2015 | Yeh | E05B 65/00 | 70/14 |
| D738,187 | S * | 9/2015 | Garthe | D8/330 | |
| 2007/0240766 | A1 * | 10/2007 | Brojanac | E05B 67/383 | 137/385 |
| 2014/0060128 | A1 * | 3/2014 | Fuller | F16K 35/10 | 70/211 |
| 2014/0250955 | A1 * | 9/2014 | Miller | H01H 9/282 | 70/174 |
| 2015/0315822 | A1 * | 11/2015 | Garthe | E05B 73/0005 | 70/15 |

* cited by examiner

*Primary Examiner* — Suzanne Barrett
(74) *Attorney, Agent, or Firm* — Ancel W. Lewis, Jr.

(57) ABSTRACT

A locking device has a pair of plates and a locking member between the plates that slides between a locked and unlocked position. One or more padlock bars fit between the plates to secure the locking member in the locked position. Padlocks on each end of each padlock bar lock the padlock bars between the plates. When in the locked position, the locking member secures a latch opposite the padlock bars. The latch can be a chain, bar or tube.

18 Claims, 3 Drawing Sheets

MULTIPLE PADLOCK LOCKING DEVICE

TECHNICAL FIELD

The present invention relates to locking devices, and more particularly to a more particularly to a locking device for use with multiple padlocks.

BACKGROUND ART

Multiple lock systems are used to allow access to an area by multiple users while preventing access to unauthorized persons. Such systems may be used, for example, on property with oil and gas leases, hunting leases, or wireless communications towers. One advantage of multiple lock systems over a single lock system is that a user authorized to access multiple areas may use locks with the same key for each area, eliminating the need for that user to carry multiple keys and reducing confusion over which key provides access to which area. Another advantage is that when a user is no longer authorized to access the area, the user's lock can be replaced or eliminated, and the distribution of new keys to all of the other users is not required.

One simple prior known multiple lock system uses a chain around a gatepost and a post on a gate secured by multiple padlocks linked in series with each user having their own padlock and key. One disadvantage of this system is that a user may bypass one or more locks when resecuring the chain, thereby preventing access to the users of the bypassed locks. Another disadvantage is that one user can remove the whole system. Detection of an unauthorized lock, added by cutting the chain and inserting the lock, is very difficult with this system.

U.S. Pat. No. 7,503,194 to the present applicant discloses a multiple padlock system with links that encircle a gatepost and links that encircle a post of a gate. This system and the chain system described above generally require an accessible gatepost and an accessible post on the gate. U.S. Pat. No. 6,857,299 to the present applicant discloses a multiple padlock system with a plurality of push bolts that each accept a padlock, and a sliding bar that is released by removing a padlock and pressing the associated push bolt. The number of push bolts can be easily changed by a master user, and the system can be used with almost any type of gates and with doors.

DISCLOSURE OF THE INVENTION

A locking device for use with multiple padlocks includes a pair of spaced plates with spacers between the plates. A locking member between the plates is slidable between an unlocked position that is closer to a second end of the plates and a locked position that is further from the second end. A latch enclosure at a first end of the plates defines a shaped latch cavity and the locking member projects into the latch cavity when the locking member is in the locked position. A padlock bar cavity is defined by the plates, spacers at the second end of the plates and the locking member when the locking member is in the locked position. One or more padlock bars extend through the padlock bar cavity and project beyond the side edges of the plates when the locking member is in the locked position, preventing the locking member from moving to the unlocked position. The padlock bars have a padlock aperture at each end to receive a shackle of a padlock. A latch member is sized and shaped to extend through the latch cavity. The latch member has an engagement portion that is engaged by the locking member when the latch member is in the latch cavity and the locking member is in the locked position to secure the latch member in the latch cavity. When a padlock is removed from a padlock aperture, the associated padlock bar can be removed from the padlock bar cavity, allowing the locking member to move to the unlocked position to release the latch member from the latch cavity.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
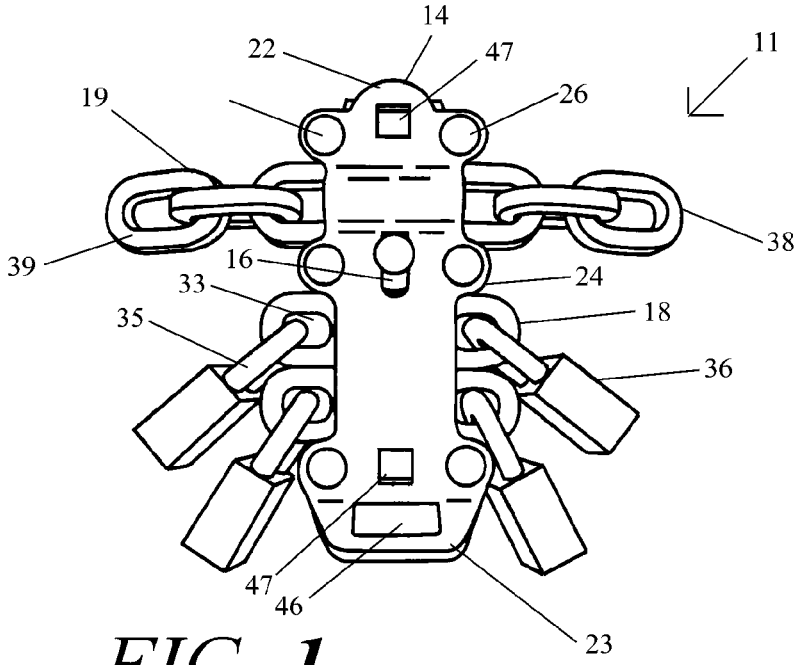
FIG. 1 is a front elevation view of a locking device embodying features of the present invention.
Figure 2:
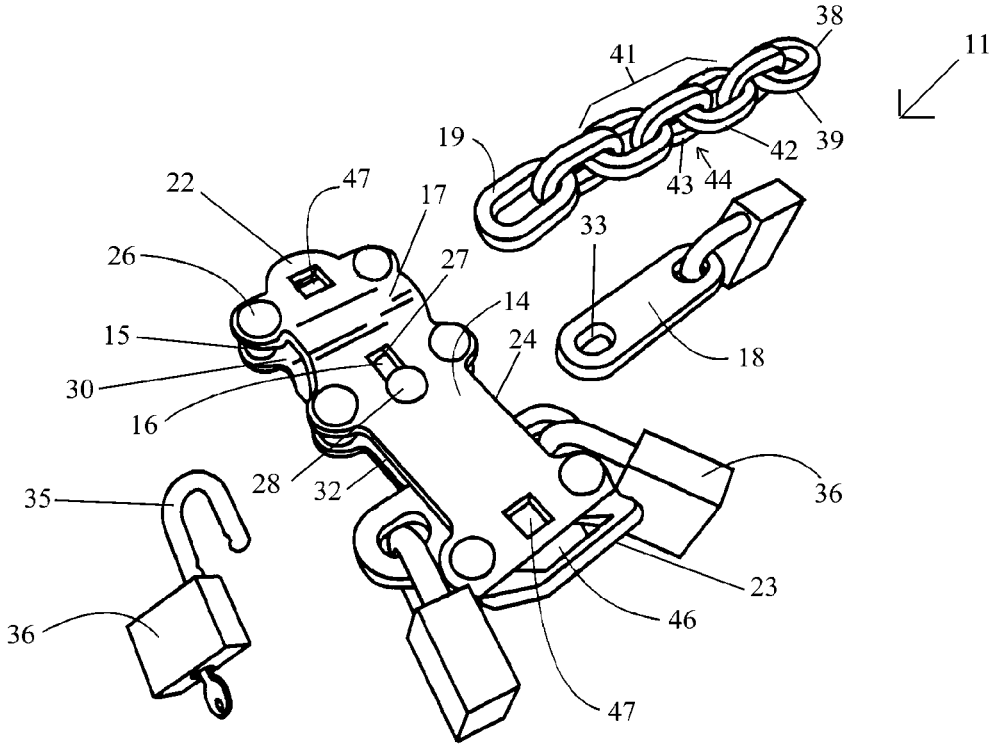
FIG. 2 is a perspective view of the locking device of FIG. 1, with the device unlocked.
Figure 3:
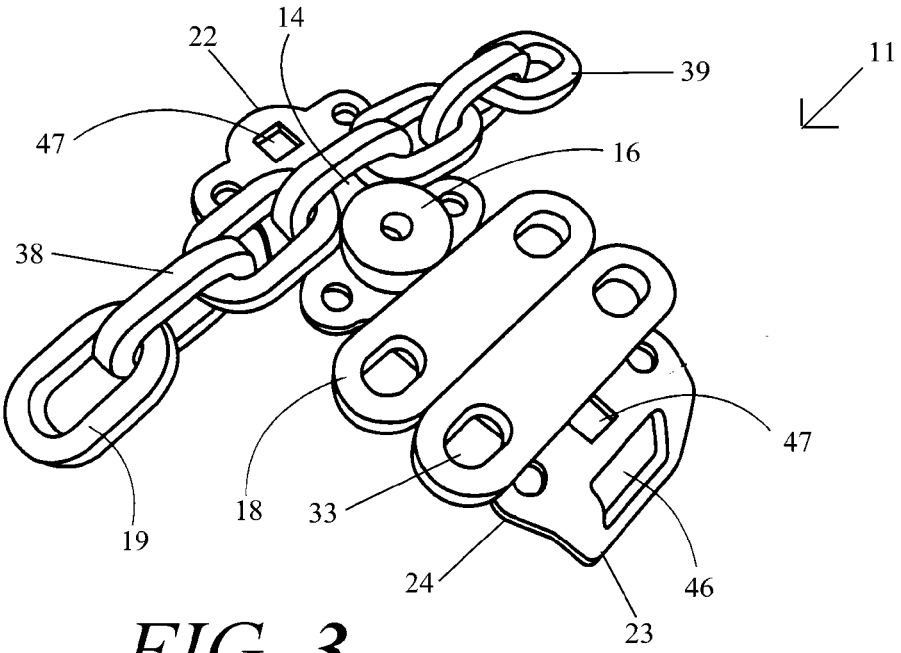
FIG. 3 is a partial, exploded view of the locking device of FIG. 1.
Figure 4:
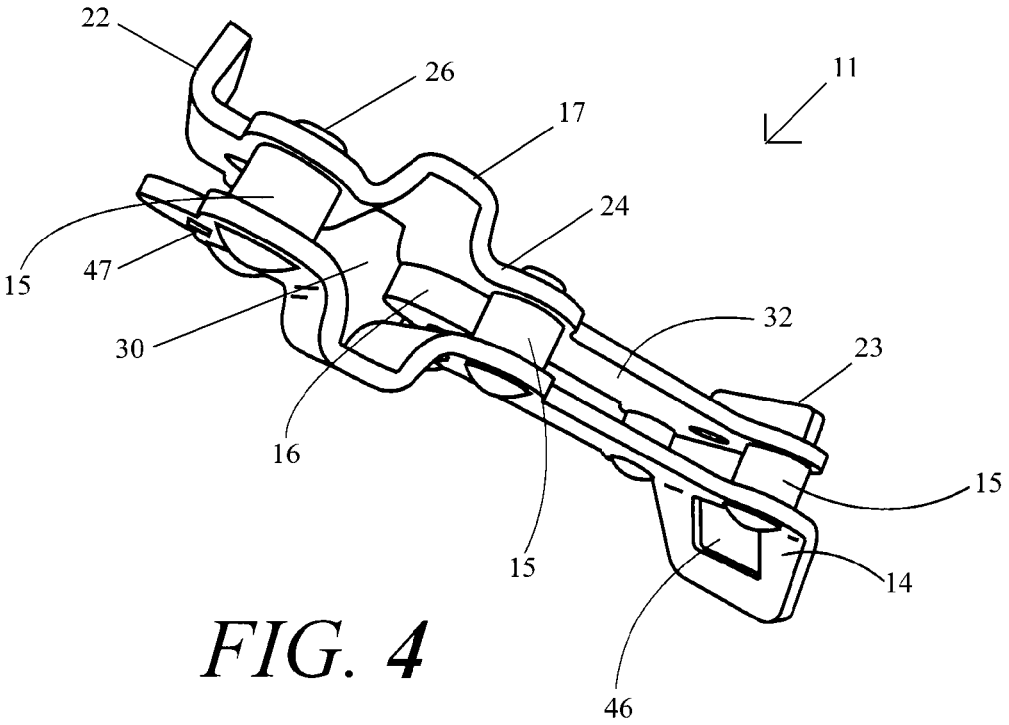
FIG. 4 is a side perspective view of the locking device of FIG. 1.

Referring to FIGS. 1-4, a locking device 11 embodying features of the present invention includes two plates 14, a plurality of spacers 15, a locking member 16, a latch enclosure 17, one or more padlock bars 18 and a latch member 19. Each plate 14 has a first end 22, a longitudinally spaced second end 23, and a pair of laterally spaced side edges 24 that each extend from the first end 22 to the second end 23.

The spacers 15 fit between the plates 14 and space the plates 14 apart. The spacers 15 shown have a hollow cylindrical shape and rivets 26 extend through one plate 14, the spacers 15 and the other plate 14 to connect the plates 14 and spacers 15 together. Other shapes of spacers 15 can be used, and other methods of connection, such as welding, can be used. The spacers 15 shown include two laterally spaced spacers 15 near the first ends 22 of the plates 14, two laterally spaced spacers 15 near the second ends 23 of the plates 14, and two laterally spaced spacers 15 intermediate the first and second ends 22 and 23 of the plates 14.

The locking member 16 fits between the plates 14, between the spacers 15 that are intermediate the first and second ends 22 and 23 of the plates 14. The locking member 16 is slidably mounted and movable between a locked position, shown in FIGS. 1 and 3, that is closer to the first ends 22 of the plates 14 and an unlocked position, shown in FIG. 2, that is closer to the second ends 23 of the plates 14.

In the locking device 11 shown, the plates 14 each have a longitudinally elongated locking member aperture 27. A locking member pin 28 extends through the locking member 16 and the locking member apertures 27 to slidably mount the locking member 16 between the plates 14. The locking member 16 shown has a disc shape. Locking members 16 of other shapes could be used.

The latch enclosure 17 is formed in the first ends 22 of the plates 14 and defines a latch cavity 30 between the locking member 16 and the spacers 15 near the first ends 22 of the plates 14. The locking member 16 projects into the latch cavity 30 when the locking member 16 is in the locked position. The latch cavity 30 shown has a generally X shaped cross section and extends between the side edges 24 of the plates 14.

The plates 14, the spacers 15 near the second ends 23 of the plates 14 and the locking member 16 when the locking member 16 is in the locked position define a padlock bar cavity 32. The padlock cavity 32 is sized to receive a selected number of padlock bars 18. The padlock bars 18 are elongated bars with a rectangular cross section and with a padlock aperture 33 at each end. The padlock apertures 33 are sized to receive the shackle 35 of a padlock 36.

The padlock bars 18 project beyond the side edges 24 of the plates 14. When all of the padlock bars 18 are in the padlock cavity 32, the padlock bars 18 prevent the locking member 16 from moving to the unlocked position. When a padlock 36 is removed from a padlock bar 18, that padlock bar 18 can be removed from the padlock cavity 32. When one padlock bar 18 is removed from the padlock cavity 32, the locking member 16 can move to the unlocked position.

The latch member 19 shown is a chain 38 of the type generally known as a plain link chain, having a plurality of interlinked oval links 39 with each link 39 being transverse to the next link 39. The chain 38 is sized to slide in the latch cavity 30 when the locking member 16 is in the unlocked position. The X shape of the latch cavity 30 prevents the links 39 in the latch cavity 30 from being rotated or twisted. Each three link section 41 of the chain 38 has two outer links 42 connected by an inner link 43. For a three link section 41 in the latch cavity 30, the locking member 16 projects between and engages the two outer links 42 when the locking member 16 is in the locked position to secure the chain 38 in the latch cavity 30. The outer links 42 form an engaging portion 44.

A padlock bar aperture 46 extends through the second end 23 of one of the plates 14. The padlock bar aperture 46 is sized to receive and hold one of the padlock bars 18 when that padlock bar 18 is removed from the padlock bar cavity 32. A pair of spaced mounting apertures 47 extend through the plates 14 for mounting the plates 14 on a first structure such as a gatepost or a door frame. One of the mounting apertures 47 shown is located between the spacers 15 near the first ends 22 of the plates 14, and the other mounting aperture 47 is located between the spacers 15 near the second ends 23 of the plates 14.

The chain 38 can be mounted on a second structure that is movable relative to the first structure when the locking device 11 is unlocked. Examples of the second structure would include a gate or door. The chain 38 can also be mounted or connected to any other item that one would want to lock to the first structure.

Figure 5:
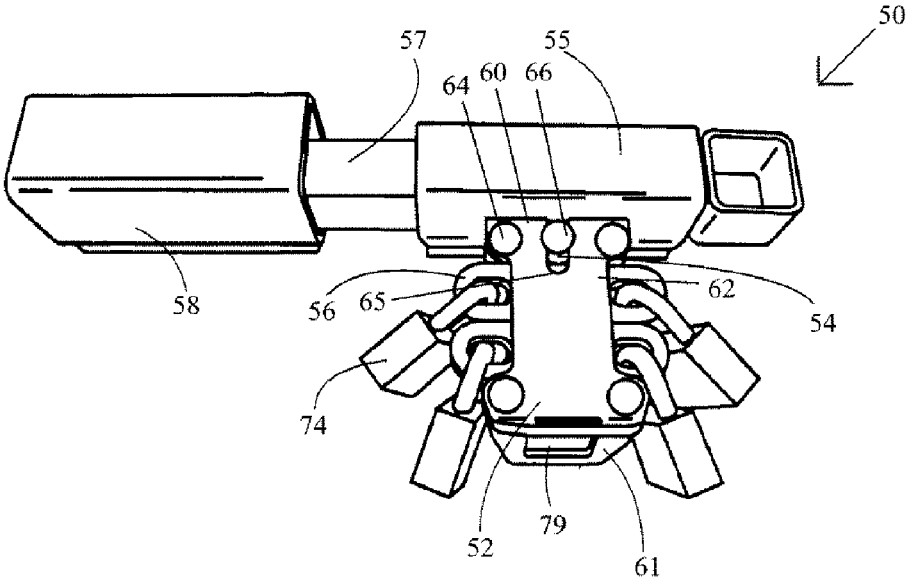
FIG. 5 is a perspective view of another locking device embodying features of the present invention.
Figure 6:
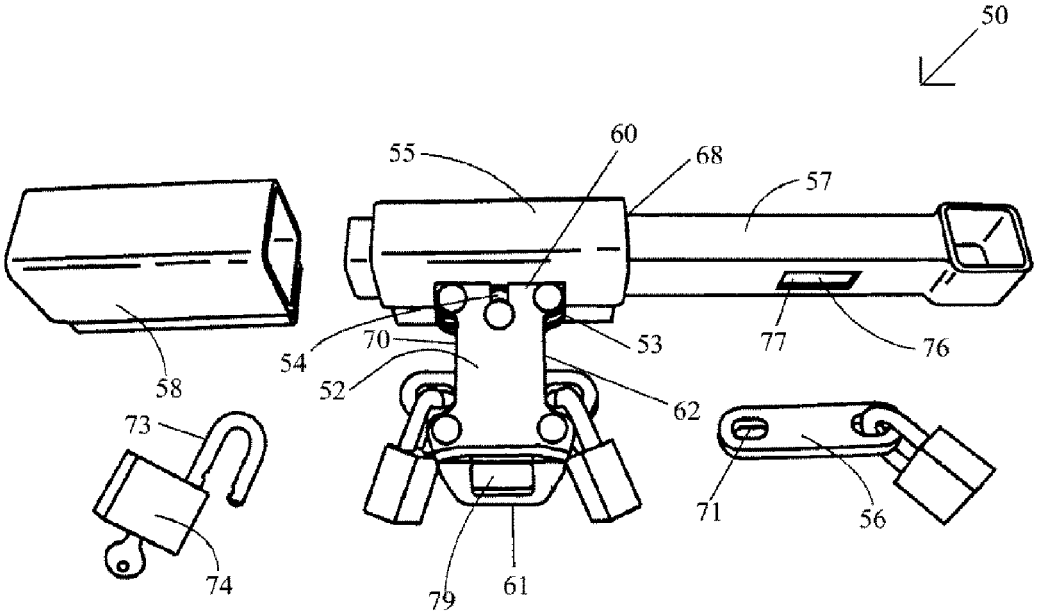
FIG. 6 is a perspective view of the locking device of FIG. 5, with the device unlocked.

FIGS. 5-6 show another locking device 50 embodying features of the present invention including two plates 52, a plurality of spacers 53, a locking member 54, a latch enclosure 55, one or more padlock bars 56, a latch member 57 and a keeper 58. Each plate 52 has a first end 60, a longitudinally spaced second end 61, and a pair of laterally spaced side edges 62 that each extend from the first end 60 to the second end 61.

The spacers 53 fit between the plates 52 and space the plates 52 apart. The spacers 53 shown have a hollow cylindrical shape and rivets 64 extend through one plate 52, the spacers 53 and the other plate 52 to connect the plates 52 and spacers 53 together. Other shapes of spacers 53 can be used, and other methods of connection, such as welding, can be used. The spacers 53 shown include two laterally spaced spacers 53 near the first ends 60 of the plates 52, two laterally spaced spacers 53 near the second ends 61 of the plates 52, and two laterally spaced spacers 53 intermediate the first and second ends 60 and 61 of the plates 52.

The locking member 54 fits between the plates 52, between the spacers 53 that are intermediate the first and second ends 60 and 61 of the plates 52. The locking member 54 is slidably mounted and movable between a locked position, that is closer to the first ends 60 of the plates 52 and an unlocked position, that is closer to the second ends 61 of the plates 52.

In the locking device 50 shown, the plates 52 each have a longitudinally elongated locking member aperture 65. A locking member pin 66 extends through the locking member 54 and the locking member apertures 65 to slidably mount the locking member 54 between the plates 52. The locking member 54 shown has a disc shape. Locking members 54 of other shapes could be used.

The latch enclosure 55 is rigidly mounted on the first ends 60 of the plates 52 and defines a latch cavity 68. The latch enclosure 55 shown is a square tube defining a laterally extending latch cavity 68 with a square cross section. The locking member 54 projects into the latch cavity 68 when the locking member 54 is in the locked position.

The plates 52, the spacers 53 near the second ends 61 of the plates 52 and the locking member 54 when the locking member 54 is in the locked position define a padlock bar cavity 70. The padlock cavity 70 is sized to receive a selected number of padlock bars 56. The padlock bars 56 are elongated bars with a rectangular cross section and with a padlock aperture 71 at each end. The padlock apertures 71 are sized to receive the shackle 73 of a padlock 74.

The padlock bars 56 project beyond the side edges 62 of the plates 52. When all of the padlock bars 56 are in the padlock cavity 70, the padlock bars 56 prevent the locking member 54 from moving to the unlocked position. When a padlock 74 is removed from a padlock bar 56, that padlock bar 56 can be removed from the padlock cavity 70. When one padlock bar 56 is removed from the padlock cavity 70, the locking member 54 can move to the unlocked position.

The latch member 57 is an elongated rigid member such as a bar or a tube sized to fit into and slide in the latch enclosure 55. The latch member 57 shown is a square tube. The latch member 57 has a locking member aperture 76 sized to receive the locking member 54. The locking member 54 projects into the locking member aperture 76 when the locking member 54 is in the locked position to secure the latch member 57. The locking member aperture 76 forms an engaging portion 77.

The keeper 58 is sized and shaped to receive a portion of the latch member 57 that projects laterally from the latch enclosure 55 when the locking member 54 is in the locked position. The keeper 58 shown has a square cross section. The keeper 58, latch member 57 and latch enclosure 55 can have rectangular, circular or other cross sections.

A padlock bar aperture 79 extends through the second end 61 of one of the plates 52. The padlock bar aperture 79 is sized to receive and hold one of the padlock bars 56 when that padlock bar 56 is removed from the padlock bar cavity 70. The latch enclosure 55 can be mounted on a structure, such as a gatepost of a door frame, and the keeper is mounted on a second structure that is movable relative to the first structure when the locking device 50 is unlocked, such as a gate or door. When the locking device 50 is unlocked, the latch member 57 is pulled out of the keeper 58 to allow the gate or door to open.

Although the present invention has been described with a certain degree of particularity, it is understood that the present disclosure has been made by way of example and that changes in details of structure may be made without departing from the spirit thereof.

What is claimed is:

1. A locking device for use with multiple padlocks comprising:

a pair of spaced plates each having a first end a spaced second end, and a pair of side edges extending from said first end to said second end, at least one spacer between said plates near said second end of said plates, said spacer and said plates being rigidly connected, a locking member slidably mounted between said plates, said locking member being slidable between an unlocked position that is closer to said second end and a locked position that is further from said second end, said plates, said spacer and said locking member defining a padlock bar cavity when said locking member is in said locked position, a latch enclosure at said first ends of said plates, said latch enclosure defining a shaped latch cavity with said locking member projecting into said latch cavity when said locking member is in said locked position, at least one elongated padlock bar sized and shaped to extend through said padlock bar cavity when said locking member is in said locked position and prevent said locking member from moving to said unlocked position, said padlock bar projecting beyond said side edges of said plates and having a padlock aperture at each end, said padlock apertures being sized to receive a shackle of a padlock, and a latch member sized and shaped to extend through said latch cavity, said latch member having an engagement portion that is engaged by said locking member when said latch member is in said latch cavity and said locking member is in said locked position to secure said latch member in said latch cavity, whereby removal of a padlock from a padlock aperture allows removal of a padlock bar, allowing said locking member to move to said unlocked position to release said latch member from said latch cavity.

2. The locking device as set forth in claim 1 including at least two said padlock bars.

3. The locking device as set forth in claim 1 wherein said locking member is disc shaped.

4. The locking device as set forth in claim 1 wherein said latch member is a chain having a plurality of links.

5. The locking device as set forth in claim 4 wherein said chain is plain link chain with each three link section having two outer links connected by an inner link, said outer links forming said engaging portion with said locking member projecting between said outer links when said locking member is in said locked position to prevent release of said latch member.

6. The locking device as set forth in claim 5 wherein said latch enclosure is formed to define an X shaped latch cavity that is sized and shaped to receive said links and to prevent twisting said links that are in said latch cavity.

7. The locking device as set forth in claim 6 wherein said latch enclosure is formed in said first ends of said plates.

8. The locking device as set forth in claim 1 wherein said latch member is a rigid member slidable in said latch cavity.

9. The locking device as set forth in claim 8 including a keeper sized and shaped to receive said latch member.

10. The locking device as set forth in claim 9 wherein said latch member is a tube.

11. The locking device as set forth in claim 10 wherein said latch member is a square tube.

12. The locking device as set forth in claim 11 wherein said keeper is a square tube sized to receive said latch member and mounted on said first ends of said plates.

13. The locking device as set forth in claim 9 wherein said engagement portion is an aperture in said latch member that is sized and shaped to receive a portion of said locking member.

14. The locking device as set forth in claim 1 including two laterally spaced cylindrical spacers between said plates near said second end, two laterally cylindrical spacers between said plates spaced laterally outwardly on each side of said locking member, and a plurality of rivets with each rivet extending though one plate, a said spacer and the other plate to connect said plates.

15. The locking device as set forth in claim 1 wherein said second end of at least one of said plates includes a padlock bar aperture sized to receive a said padlock bar when said padlock bar is removed from said padlock bar cavity.

16. The locking device as set forth in claim 1 wherein said plates include at least two mounting apertures for mounting said plates on a structure.

17. A locking device for use with multiple padlocks comprising:

a pair of spaced plates each having a first end a spaced second end, and a pair of side edges extending from said first end to said second end, a pair of laterally spaced spacers between said plates near said second end of said plates, said spacer and said plates being rigidly connected, a disc shaped locking member slidably mounted between said plates, said locking member being slidable between an unlocked position that is closer to said second end and a locked position that is further from said second end, said plates, said spacer and said locking member defining a padlock bar cavity when said locking member is in said locked position, a latch enclosure formed in said first ends of said plates to define an X shaped latch cavity with said locking member projecting into said latch cavity when said locking member is in said locked position, at least two elongated padlock bars sized and shaped to extend through said padlock bar cavity when said locking member is in said locked position and prevent said locking member from moving to said unlocked position, said padlock bars projecting beyond said side edges of said plates and having a padlock aperture at each end, said padlock apertures being sized to receive a shackle of a padlock, and a plain link chain sized to extend through said latch cavity, each three link section of said chain having two outer links connected by an inner link, said outer links forming an engaging portion with said locking member projecting between said outer links when said locking member is in said locked position to prevent release of said chain and secure said chain in said latch cavity, whereby removal of a padlock from a padlock aperture allows removal of a padlock bar, allowing said locking member to move to said unlocked position to release said chain from said latch cavity.

18. A locking device for use with multiple padlocks comprising:

a pair of spaced plates each having a first end a spaced second end, and a pair of side edges extending from said first end to said second end, a pair of laterally spaced spacers between said plates near said second end of said plates, said spacer and said plates being rigidly connected, a disc shaped locking member slidably mounted between said plates, said locking member being slidable between an unlocked position that is closer to said second end and a locked position that is further from said second end, said plates, said spacer and said locking member defining a padlock bar cavity when said locking member is in said locked position, a square tubular latch enclosure attached to said first ends of said plates, said latch enclosure defining an elongated square latch cavity with said locking member projecting into said latch cavity when said locking member is in said locked position, at least two elongated padlock bars sized and shaped to extend through said padlock bar cavity when said locking member is in said locked position and prevent said locking member from moving to said unlocked position, said padlock bars projecting beyond said side edges of said plates and having a padlock aperture at each end, said padlock apertures being sized to receive a shackle of a padlock, and a latch member of square tube sized to extend through and slidable in said latch cavity, said latch member having an engagement portion that is engaged by said locking member when said latch member is in said latch cavity and said locking member is in said locked position to secure said latch member in said latch cavity, whereby removal of a padlock from a padlock aperture allows removal of one said padlock bar, allowing said locking member to move to said unlocked position to release said latch member from said latch cavity.

* * * * *